United States Patent [19]

Yokoyama et al.

[11] Patent Number: 4,487,185

[45] Date of Patent: Dec. 11, 1984

[54] AIR-FUEL MIXTURE INTAKE APPARATUS FOR INTERNAL COMBUSTION ENGINES

[75] Inventors: Hiroshi Yokoyama; Tokuzi Ishida, both of Hamamatsu, Japan

[73] Assignee: Suzuki Jidosha Kogyo Kabushiki Kaisha, Shizuoka, Japan

[21] Appl. No.: 340,714

[22] Filed: Jan. 19, 1982

[30] Foreign Application Priority Data

Jan. 31, 1981 [JP] Japan ..... 56-13101
Mar. 6, 1981 [JP] Japan ..... 56-30298[U]
Mar. 6, 1981 [JP] Japan ..... 56-30299[U]

[51] Int. Cl.[3] ..... F02M 11/04

[52] U.S. Cl. ..... 123/432; 123/442; 261/23 A

[58] Field of Search ..... 123/308, 432, 442; 261/23 A, DIG. 56

[56] References Cited

U.S. PATENT DOCUMENTS

| | | | |
|---|---|---|---|
| 3,596,642 | 8/1971 | Nakata | 261/23 A |
| 3,756,209 | 9/1973 | Hida et al. | 261/23 A |
| 3,885,004 | 5/1975 | Marsee | 261/23 A |
| 4,098,850 | 7/1978 | Tamura | 261/65 |
| 4,146,593 | 3/1979 | Higashigawa | 261/23 A |
| 4,169,871 | 10/1979 | Eason | 261/23 A |
| 4,257,374 | 3/1981 | Matsumoto et al. | 123/432 |
| 4,300,500 | 11/1981 | Motosugi et al. | 123/432 |

*Primary Examiner*—Parshotam S. Lall

*Assistant Examiner*—W. R. Wolfe

*Attorney, Agent, or Firm*—Flynn, Thiel, Boutell & Tanis

[57] ABSTRACT

An air-fuel mixture intake apparatus for internal combustion engines includes a two-barrel carburetor having a primary venturi for supplying an air-fuel mixture into a combustion chamber under all loads and a secondary venturi for supplying an air-fuel mixture into the combustion chamber under medium and high loads. The primary venturi is of a fixed cross section and the secondary venturi is of a variable cross section. A vacuum-operated actuator controls operation of a secondary throttle valve in response to a vacuum developed in the primary venturi and subsequently in the secondary venturi. The secondary throttle valve is interlinked with a primary throttle valve by a linkage mechanism such that the secondary throttle valve is allowed to open when the primary throttle valve opens to a predetermined degree with the maximum opening of the secondary throttle valve being variably controlled by the opening of the primary throttle valve after the latter has opened beyond the predetermined degree. A delay valve is disposed in a primary vacuum signal passageway or a common vacuum signal passageway connected to a vacuum chamber of the vacuum-operated actuator to delay an air flow through the passageway toward a vacuum pickup probe in the primary venturi. The secondary throttle valve may be mounted on a shaft displaced downstream off the geometric center of the secondary throttle valve.

6 Claims, 9 Drawing Figures

AIR-FUEL MIXTURE INTAKE APPARATUS FOR INTERNAL COMBUSTION ENGINES

BACKGROUND OF THE INVENTION

1. Field of the Invention

The present invention relates to an air-fuel mixture intake apparatus having a two-barrel or duplex carburetor for internal combustion engines.

2. Prior Art

There has been a strong need for internal combustion engines which will emit a reduced amount of pollutants such as carbon monoxide and unburned hydrocarbons and improve fuel economy without impairing engine performance and lowering the thermal efficiency of engines.

Various systems such as lean air-fuel mixture combustion systems or EGR systems have been practiced to reduce harmful components in the exhaust gas and achieve better mileage. These known systems have proven unsatisfactory in that in low-load operating conditions or especially in low-speed, low-load operating conditions, the volumetric efficiency of an air-fuel mixture introduced into a combustion chamber is low and an increased amount of exhaust gas tends to remain in the combustion chamber, and the air-fuel mixture in the chamber cannot easily be ignited. Furthermore, the speed of combustion and hence the speed of travel of flames are low, resulting in unstable fuel combustion in the combustion chamber. The foregoing systems thus have the disadvantages of low thermal efficiency and sluggish engine operation.

Improved engine performance, efficiency and fuel economy accompanied by better emission control can be best achieved by speeding up fuel combustion in combustion chambers. To increase the rate of combustion, there have been proposed many arrangements which are designed to burn an air-fuel mixture at a higher speed by developing disturbances in the air-fuel mixture, to promote fuel carburetion, and to uniformize fuel distribution among engine cylinders.

One of the proposed arrangements comprises an auxiliary intake passage for generating swirls in a combustion chamber during the intake stroke. Another proposal is composed of a combustion of primary and secondary intake passages, with primary and secondary throttle valves located closely to a combustion chamber in some applications. According to still another construction, a projection or a valve is disposed adjacent to an intake valve to produce a biased flow of airflow mixture.

The auxiliary intake passage is designed to introduce an air-fuel mixture into the combustion chamber at a high speed. With the cross section of a main intake passage being selected to suit high-speed, high-load engine operation, the speed of flow of the air-fuel mixture becomes reduced in lowload operating ranges in which the volumetric efficiency is small, with the results that sufficient swirls will not be generated in a combined flow of air-fuel mixtures from the main and auxiliary intake passages. The auxiliary intake passage is less effective to produce swirls than desired under medium and high load conditions in which the throttle valve is wide open and the boost pressure is relatively small. With the auxiliary intake passage, fuel tends to be less atomized during idling operation due to a bypassing flow of air-fuel mixture.

The speed of flow of air through the venturi of a carburetor is low and hence fuel is not fully atomized in low-load engine operation. Such insufficient fuel atomization causes fuel in a liquid form to flow down an intake passage into a combustion chamber, with the result that air and fuel will not be mixed uniformly and fuel will not be distributed uniformly among engine cylinders, resulting in poor fuel combustion in the engine cylinders.

To improve fuel combustion in low-load operating conditions, there has been devised a carburetor having a variable venturi which is variable in cross section in order to keep substantially constant the speed of flow of air through the venturi where a fuel discharge nozzle is located, irrespective of varying amounts of air flowing through the venturi. Although the variable venturi enables an engine to operate relatively stably and flexibly in a wide operating range from low load to full load conditions, it fails to effect stable air flow control when the throttle valve opens slightly because the venturi cross section does not change appreciably even if the opening of the throttle valve varies. Therefore, exhaust gas purification cannot be achieved by the variable venturi while the engine operates under small loads.

There have been known internal combustion engines equipped with a duplex or two-barrel carburetor or with primary and secondary intake passages for each engine cylinder, the secondary intake passage being put into service under certain load conditions. Such an intake system is more advantageous than single-carburetor intake systems in that it can effect better fuel atomization particularly in low to medium load ranges, cause more disturbances in the air-fuel mixture in a combustion chamber, and improve the rate of fuel combustion. An internal corbustion engine having a secondary throttle valve provided for each engine cylinder and actuatable when the engine is subjected to a higher load can prevent interference between the cylinders such as leakage of the air-fuel mixture therebetween on the secondary side, resulting in better fuel distribution among the engine cylinders. When secondary throttle valves are inadequate in their opening and closing motions or cannot be closed completely, the engine operation becomes as unstable as there are such defective secondary throttle valves since each engine cylinder is equipped with a secondary throttle valve. During deceleration, the secondary throttle valves subjected to bouncing or re-opening motion under a large negative pressure developed in the combustion chambers, with the consequences that stability and recovery of idling operation are poor, and the rpm of the engine during idling operation is relatively high, resulting in worse fuel economy. Furthermore, the secondary throttle valves open rapidly during acceleration, and hence the engine performance becomes impaired in the acceleration mode due to retarded fuel introduction into the engine cylinders.

SUMMARY OF THE INVENTION

An air-fuel mixture intake apparatus for internal combustion engines includes a primary intake system having a fixed venturi for supplying an air-fuel mixture under all load conditions and a secondary intake system having a variable venturi for supplying an additional air-fuel mixture under medium and high loads, the primary intake system being designed to meet fuel supply requirements under low loads. The variable venturi communicates through a secondary intake passage and an intake valve with a combustion chamber, and the fixed venturi communicates through a primary intake passage with the secondary intake passage adjacent to the intake valve. The primary and secondary intake systems include primary and secondary throttle valves, respectively, for controlling the amounts of air-fuel mixtures flowing into the primary and secondary intake passages. The second throttle valve is operable by a vacuum-operated actuator when there is developed a negative pressure or vacuum at the fixed venturi as the primary throttle valve opens to a certain degree. The secondary throttle valve is operatively connected to the primary throttle valve by a linkage mechanism such that the secondary throttle valve is allowed to open after the primary throttle valve has opened with the maximum opening of the secondary throttle valve being variably controlled by the primary throttle valve.

According to another embodiment, a delay valve is located in a vacuum signal passageway connected between the vacuum-operated actuator and a vacuum pickup probe in the venturi on the primary side, or vacuum pickup probes in the venturis on the primary and secondary sides. The delay valve causes the vacuum-operated actuator to actuate the secondary throttle valve slowly in its opening motion and rapidly in its closing motion. A modified secondary throttle valve is angularly movable about a shaft which is displaced downstream off the geometric center of the secondary throttle valve such that the valve will move slowly when it is opened and quickly when it is closed.

It is an object of the present invention to provide an air-fuel mixture intake apparatus which will supply an air-fuel mixture at an adequate rate under low-load operating conditions and will achieve promoted and stabilized fuel atomization under medium and high loads for stable fuel combustion and improved exhaust gas purification and thermal efficiency.

Another object of the present invention is to provide an air-fuel mixture intake apparatus which will improve stability and recovery of idling operation of an internal combustion engine.

Still another object of the present invention is to provide an air-fuel mixture intake apparatus which enables internal combustion engines to have better fuel economy and reduce harmful components in an exhaust gas discharged therefrom.

A still further object of the present invention is to provide an air-fuel mixture intake apparatus for allowing internal combustion engines to operate smoothly in transient conditions between engine operations under low and high loads.

The above and other objects, features and advantages of the present invention will become more apparent from the following description when taken in conjunction with the accompanying drawings in which certain preferred embodiments of the present invention are shown by way of illustrative example.

DETAILED DESCRIPTION OF THE PREFERRED EMBODIMENTS

Figures 2, 4, 5:
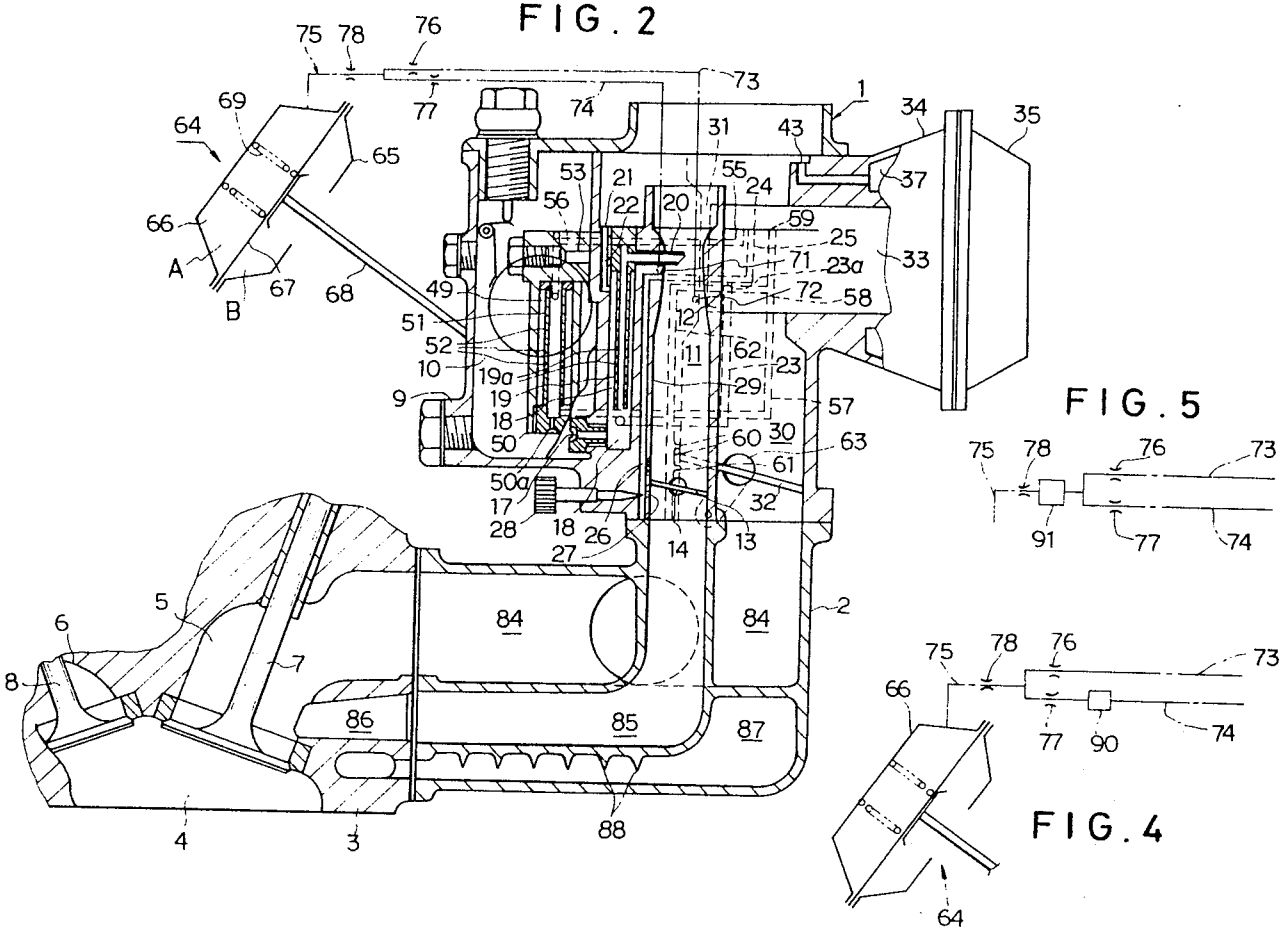
FIG. 2 is a vertical cross-sectional view of the intake system in which the duplex carburetor shown in FIG. 1 is incorporated.
FIG. 4 is a diagrammatic view of a modified vacuum passage.
FIG. 5 is a diagrammatic view of another modified vacuum passage.

As shown in FIG. 2, an air-fuel mixture intake apparatus for an internal combustion engine according to the present invention comprises a duplex or two-barrel carburetor 1 and an intake pipe 2 which connects the carburetor 1 to a cylinder head 3 having therein a combustion chamber 4. The cylinder head 3 has an intake port 5 and an exhaust port 6 both opening into the combustion chamber 4. The cylinder head 3 supports an intake valve 7 for opening and closing the intake port 5 with respect to the combustion chamber 4, and an exhaust valve 8 for opening and closing the exhaust port 6 with respect to the combustion chamber 4. The carburetor 1 has a body 9 and a float chamber or bowl 10 defined in the body 9.

The carburetor 1 includes a primary intake system for supplying an air-fuel mixture under all load conditions and a secondary intake system for supplying an air-fuel mixture under medium and high loads to which the engine is subjected while in operation.

The primary intake system comprises a small-diameter intake passage 11 defined in the body 9, a primary venturi 12 of a fixed cross section disposed in the intake passage 11, and a primary throttle valve 13 mounted in the intake passage 11 and positioned downstream of the primary venturi 12. The primary throttle valve 13 is supported on a throttle shaft 14 to which there is fixed a lever 15 (FIG. 3) which is connected to one end of a wire 16 with the other end thereof coupled to an accelerator pedal (not shown). The primary venturi 12 is of such a cross section as to promote atomization of fuel when the engine operates under small loads.

The primary intake system is composed of a main fuel supply subsystem and a slow fuel supply subsystem. The primary main fuel supply subsystem comprises a main jet 17 opening into the float chamber 10, a fuel well 18 communicating via the main jet 17 with the float chamber 10, a bleed pipe 19 inserted in the fuel well 18 and having air bleed holes **19*a*, a main nozzle 20 having one end communicating with the bleed pipe 19 and the other end opening into the primary venturi 12, a main air jet 21 held in communication with an air cleaner (not shown), and a passage 22 which provides communication between the main air jet 21 and the fuel well 18**.

The primary slow fuel supply subsystem comprises a passage 23 communicating with the fuel well 18 at its lower portion, a slow air jet 24 held in communication with a slow jet **23*a* in the passage 23 and the air cleaner, a passage 25 which communicates with the slow air jet 24, bypass ports 26 opening into the intake passage 11 upstream of the primary throttle valve 13, an idle port 27 opening into the intake passage 11 downstream of the primary throttle valve 13, an adjustment screw 28 for adjusting the opening of the idle port 27, and a passage 29 which provides communication between the passages 23, 25 and the bypass and idle ports 26, 27**.

The secondary intake system includes an intake passage 30 defined in the body 9, a variable venturi 31 disposed in the intake passage 30, and a secondary throttle valve 32 mounted in the intake passage 30 and positioned downstream of the variable venturi 31. The variable venturi 31 is defined jointly by an inner wall surface of the intake passage 30 and a piston valve 33 supported by the body 9 so as to be reciprocably movable in a direction transverse of the longitudinal axis of the intake passage 30.

Figure 1:
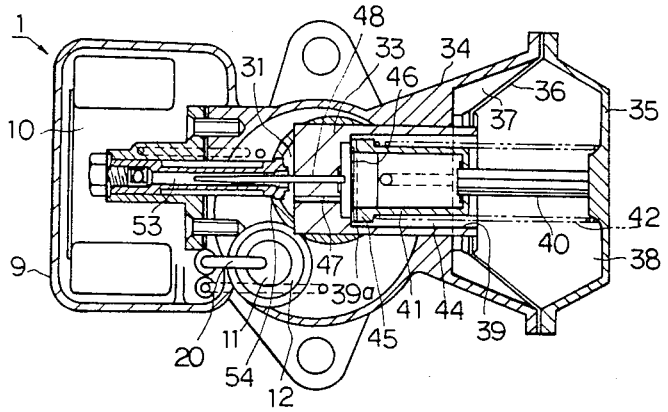
FIG. 1 is a horizontal cross-sectional view of a duplex carburetor in an intake system according to the present invention.

The piston valve 33 is part of a variable venturi mechanism which, as best shown in FIG. 1, comprises a lateral projection 34 integral with the body 9, a cover 35 attached to the projection 34, a diaphragm 36 sandwiched around its peripheral edge between the cover 35 and the projection 34, an atmospheric-pressure chamber 37 defined as a recess in the projection 34 and partly bounded by the diaphragm, and a vacuum chamber 38 defined between the diaphragm 36 and the cover 35. The piston valve 33 is connected to the diaphram 36 and has bore 39 opening into the vacuum chamber 38. A support shaft 40 is mounted on the cover 35 and extends coaxially with the piston valve 33. A spring seat 41 is axially slidably mounted on the support shaft 40, and disposed in the bore 39 with one end held in abutaent against a shoulder 39*a* at the bottom of the bore 39. A compression coil spring 42 is disposed between the spring seat 41 and the cover 35. The atmospheric-pressure chamber 37 is held in communication with the air cleaner via a passageway 43 (FIG. 2). The vacuum chamber 38 communicates with the variable venturi 31 through a passageway 44 defined between the spring seat 41 and the piston valve 33 along the bore 39 therein, a side groove 45 defined in the end of the spring seat 41, a passageway 46 defined between the spring seat 41 and the bottom of the bore 39, and a passageway 47 extending axially through the piston valve 33. The piston valve 33 has a coaxial needle 48 as illustrated in FIG. 1.

The secondary intake fuel system is composed of a main fuel supply subsystem and a slow fuel supply subsystem. The secondary main fuel supply subsystem comprises, as shown in FIG. 2, a fuel well 49, a plug 50 threaded in an open end of the fuel well 49, a main jet 50*a* in the plug 50, a bleed pipe 51 integral with the plug 50 and inserted in the fuel well 49, the bleed pipe 51 having air bleed holes 52, a passage 53 communicating between the variable venturi 31 and the bleed pipe 51, a needle jet 54 (FIG. 1) disposed in the passage 53 at an end thereof which opens into the variable venturi 31, a main air jet 55 opening toward the air cleaner, and a passage 56 through which the main air jet 55 communicates with the fuel well 49. The needle 48 is inserted through the needle jet 54 into the passage 53.

The secondary slow fuel supply subsystem includes a passage 57 communicating with the bleed pipe 51, a slow jet 58 disposed in the passage 57, a slow air jet 59 opening toward the air cleaner, bypass ports 60 opening into the secondary intake passage 30 upstream of the secondary throttle valve 32, an idle port 63 opening into the intake passage 30 downstream of the secondary throttle valve 32, and a passage 62 which provides communication between the slow jet 58, slow air jet 59 and the bypass and idle ports 60, 61.

The secondary throttle valve 32 is mounted on a throttle shaft 63 and controlled for its opening and closing motion by a valve control device. The secondary throttle valve 32 is variably limited in its opening by a linkage mechanism which is interlinked with the primary throttle valve 13.

The valve control device for actuating the secondary throttle valve 32 comprises a vacuum-operated actuator 64 having a housing 65, a cover 66 mounted on the housing 65, a diaphragm 67 sandwiched between the housing 65 and the cover 66, a rod 68 supported on the diaphragm 67, and a compression coil spring 69 interposed between the cover 66 and the diaphragm 67. The cover 66 and the diaphragm 67 jointly define a vacuum chamber A therebetween, and the diaphragm 67 and the housing 65 jointly define a chamber B therebetween which is vented to atmosphere.

The rod 68 of the vacuum-operated actuator 64 is pivotably coupled to a distal end of a lever 70 (FIG. 3) fixed to the throttle shaft 63. As shown in FIG. 2, a vacuum pickup port or probe 71 opens into the venturi 12 on the primary side, and a vacuum pickup port or probe 72 opens into the variable venturi 31 on the secondary side. The vacuum pickup ports 71, 72 are held in communication with the vacuum chamber A of the vacuum-operated actuator 64 through vacuum signal passageways 73, 74, respectively, and a common vacuum signal passageway 75. The vacuum signal passageways 73, 74, 75 include orifices or restrictors 76, 77, 78, respectively.

Figure 3:
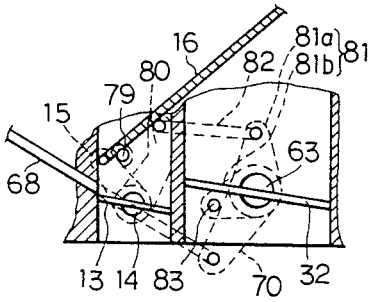
FIG. 3 is an enlarged fragmentary cross-sectional view of primary and secondary throttle valves which are interlinked.

The linkage mechanism by which the throttle valves 13, 32 are operatively interlinked comprises, as illustrated in FIG. 3, a roller 79 rotatably supported on the lever 15 secured to the throttle shaft 14, a bell crank lever 80 rotatably mounted on the throttle shaft 14, a bell crank lever 81 having lever portions 81*a*, 81*b* and rotatably mounted at its intermediate portion on the throttle shaft 63, a rod 82 connected between the lever 80 and the lever portion 81*a*, and a limit pin 83 mounted on the lever portion 81*b*.

When the primary throttle valve 13 is opened to a predetermined extent, the roller 79 is brought into engagement with the lever 80, and when the primary throttle valve 13 is opened beyond that extent, the roller 79 causes the lever 80 to turn clockwise as shown in FIG. 3. The lever 70 is angularly movable into abutting engagement with the limit pin 83.

The variable venturi 31 on the secondary side is kept in communication with the combustion chamber 4 via a secondary intake conduit, and the fixed venturi 12 on the primary side is kept in communication through a primary intake conduit of a smaller diameter than that of the secondary intake conduit with the latter adjacent to the intake valve 7.

The secondary intake conduit is comprised of the portion of the intake passage 30 which is downstream of the variable venturi 31, an intake passage 84 defined in the intake pipe 2, and the intake port 5 communicating with the intake passage 84. The primary intake conduit comprises the portion of the intake passage 11 which is downstream of the fixed venturi 13, a small-diameter intake passage 85 defined in the intake pipe 2, and a tapered intake passage 86 defined in the cylinder head 2 and communicating with the intake passage 85, the tapered intake passage 86 opening into the intake port 5 adjacent to the intake valve 7. As shown in FIG. 2, the primary intake conduit is smaller in diameter than the secondary intake conduit. Although not shown, the opening of the tapered intake passage 86 is directed circumferentially of the combustion chamber 4. The intake pipe 2 includes a coolant water passageway 87 into which a plurality of cooling fins 88 project.

The air-fuel mixture intake apparatus thus constructed will operate as follows:

IDLING MODE

In an idling mode of operation of the engine, the primary and secondary throttle valves 13, 32 are fully closed, and a high vacuum develops only at the idle ports 27, 61 during the suction stroke of the engine. As a result, fuel which is supplied from the float chamber 10 through the main jet 50*a* into the bleed pipe 19 is drawn via the passage 57 and the slow jet 58 into the passage 62. At the same time, air coming from the air cleaner is introduced through the slow air jet 59 into the passage 62. The fuel and air thus supplied are mixed together in the passage 62, and the mixture is atomized and ejected from the idle port 61 into the secondary intake passage 30 downstream of the secondary throttle valve 32. The atomized air-fuel mixture is introduced into the combustion chamber 4 through the intake passage 84 and the intake port 5.

Fuel is also supplied from the float chamber 10 through the main jet 17 into the fuel well 18, from which fuel is drawn into the passage 29 through the passage 23 and the slow jet 23*a*. Simultaneously, air supplied from the air cleaner is drawn via the slow air jet 24 and the passage 25 into the passage 29. The fuel and air thus supplied are mixed together in the passage 29 and ejected in atomized form from the idle port 27 into the primary intake passage 11 downstream of the primary throttle valve 13. The atomized air-fuel mixture is fed at a high speed into the combustion chamber 4 along its circumferential wall through the intake passages 85, 86. The air-fuel mixture is thus introduced as strong swirls into the combustion chamber 4 when the engine is in the suction stroke while in idling operation.

UNDER LIGHT LOADS

When the accelerator pedal is depressed, the wire 16 is pulled to turn the lever 15 clockwise, opening the primary throttle valve 13. A vacuum now develops in the primary venturi 12, and air is drawn from the air cleaner through the venturi 12 toward the primary throttle valve 13. Fuel in the fuel well 18 is forced into the bleed pipe 19, and air is supplied from the air cleaner via the main air jet 21, the passage 22, the air bleed holes 19*a* into the bleed pipe 19. The fuel and air as fed into the bleed pipe 19 are mixed therein, and the mixture is atomized and discharged from the main nozzle 20 into the primary venturi 12, in which the atomized air-fuel mixture is further mixed with the air flowing directly from the air cleaner. The air-fuel mixture thus formed flows through the intake passages 11, 85, 86 and is fed circumferentially into the corbustion chamber 4. The air-fuel mixture as supplied into the combustion chamber 4 becomes increased in amount and speed of flow as the primary throttle valve 13 opens more widely.

At this time, a vacuum in the primary venturi 12 is picked up through the vacuum pickup port 71, and the vacuum signal is transmitted through the passageway 74, the orifices 77, 78, and the passageway 75 into the vacuum chamber A in the vacuum-operated actuator 64. However, the picked-up vacuum is not large enough to overcome the resiliency of the compression coil spring 69, and hence the vacuum-operated actuator 64 remains inactivated.

UNDER MEDIUM AND HIGH LOADS

When the primary throttle valve 13 is opened to a larger extent to enable the engine to meet medium and high loads, the speed of flow of the fluid through the primary venturi 12 becomes higher to allow a greater vacuum to develop at the vacuum pickup port 71. When the vacuum thus developed is increased upon continued opening of the primary throttle valve 13 to the point where the vacuum overcomes the force of the compression coil spring 69, the diaphragm 67 is caused by the vacuum in the vacuum chamber 66 to move toward the cover 66 against the bias of the coil spring 69, enabling the rod 68 to turn the lever 70 and the secondary throttle valve 32 clockwise (FIG. 3), whereupon the secondary throttle valve 32 is opened.

With the secondary throttle valve 32 thus opened, air is caused to flow from the air cleaner through the variable venturi 31 toward the secondary throttle valve 32, developing a vacuum at the needle jet 54, the vacuum pickup port 72 and the passage 47.

Fuel is now drawn from the float chamber 10 through the main jet 50*a* into the bleed pipe 51, and air is forced also into the bleed pipe 51 through the main air jet 55 and the air bleed holes 52 in the bleed pipe 51. The fuel and air are mixed in the bleed pipe 51 and discharged as atomized from the needle jet 54 into the variable venturi 31. The atomized air-fuel mixture is further mixed with the air from the air cleaner in the variable venturi 31, and the mixture is introduced through the intake passages 30, 84 and the intake port 5 into the combustion chamber 4.

The vacuum in the variable venturi 31 is picked up from the vacuum pickup port 72 and transmitted via the passageway 73, the orifice 76, the orifice 78 and the passageway 75 into the vacuum chamber A in the vacuum-operated actuator 64. The vacuum in the vacuum chamber A forces the diaphragm 67 to be displaced in a direction against the bias of the coil spring 69. After the secondary throttle valve 32 has opened, the extent of its opening is rendered quickly responsive to changes in the vacuum developed at the vacuum pickup port 72 which are in response to variations in the extent of opening of the primary throttle valve 13.

The vacuum developed in the passage 47 is introduced into the vacuum chamber 38 through the passage 46, the side groove 45 and the passage 44, and acts on the diaphragm 36 to move itself in a direction against the bias of the compression coil spring 42.

When the primary throttle valve 13 is thus caused to open progressively to a larger degree while the engine operates under medium and high loads, the vacuum developed at the vacuum pickup port 71 becomes progressively greater, causing the actuator 64 to open the secondary throttle valve 32 to a larger extent. As the secondary throttle valve 32 opens more widely, the amount of the fluid flowing through the variable venturi 31 is increased resulting in an increased vacuum developed in the passage 47. This vacuum causes the diaphragm 36 and the piston valve 33 to be displaced to the right (FIG. 1) against the force of the coil spring 42 until the vacuum counterbalances the bias of the compression coil spring 42. Therefore, the variable venturi 31 opens more widely for thereby keeping constant the speed of flow of the fluid through the variable venturi 31. The rightward movement of the piston valve 33 also increases the space between the piston valve 33 and the needle jet 54, whereupon the amount of fuel which is atomized and ejected into the variable venturi 31 is increased.

When the primary throttle valve 13 opens beyond a certain extent, the roller 79 pushes the lever 80 clockwise as shown in FIG. 3 causing the rod 82 to turn the lever 81 and hence the limit pin 83 thereon clockwise, whereupon the lever 70 and hence the secondary throttle valve 32 are now free to be opened by the rod 68 in response to operation of the vacuum-operated actuator 64. As long as the primary throttle valve 13 is kept open, the lever 80 is prevented from turning back counterclockwise beyond the position in which the lever 80 is engaged by the roller 79. The opening of the secondary throttle valve 32 is limited by the limit pin 83 which is engageable with the lever 70 and which is variably controlled in position by the roller 79 coupled to the primary throttle valve 13.

The air-fuel mixture intake apparatus of the foregoing construction has the following advantages:

Since the cross section of the variable venturi 31 is variable dependent on engine loads while the secondary side is in operation, air flows through the variable venturi at a constant high speed thus promoting atomization of fuel, so that fuel can be burned stably in the combustion chamber 4 for smooth operation of the engine. During operation of the variable venturi 31, no abrupt pressure drop is developed in the venturi 31 and hence retarded supply of fuel is prevented, resulting also in smooth engine operation. Conventional variable venturis have been unable to effect stable flow control of fuel, failing particularly to achieve a required degree of exhaust gas purification. Such prior difficulties can be eliminated by the air-fuel mixture intake apparatus of the present invention, with the variable venturi put to effective use flexibly under medium and high engine loads. An air-fuel mixture can be supplied at an optimum rate from the primary venturi, and fuel atomization can be promoted stably for stable fuel combustion, with the results that the exhaust gas purification and thermal efficiency of the engine will be improved.

FIG. 4 shows a modification in which a delay valve 90 such as a known vacuum transmitting valve is disposed in the vacuum signal passageway 74. The delay valve 90 serves to delay the flow of air through the passageway 74 toward the vacuum pickup port 71, so that operation of the vacuum-operated actuator 64 can be retarded and hence the secondary throttle valve 32 can be delayed or slowed down in its opening motion. A delay valve 91 may be disposed in the vacuum signal passageway 75 as illustrated in FIG. 5.

Figure 6:
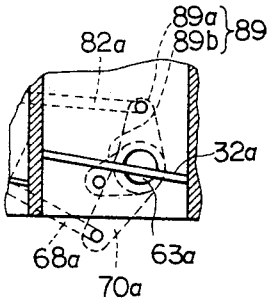
FIG. 6 is a fragmentary cross-sectional view of a modified secondary throttle valve.

A modified secondary throttle valve 32*a* shown in FIG. 6 is fixedly mounted on a shaft 63*a* which is displaced downstream off the geometric center of the secondary throttle valve 32*a*. A lever 70*a* is secured to the shaft 63*a* and coupled to a rod 68*a* of the vacuum-operated actuator as shown in FIG. 2. A bell crank lever 89 composed of lever portions 89*a*, 89*b* is rotatably mounted on the shaft 63*a* and operatively connected to the lever 80 (FIG. 3) through a rod 82*a* pivotably coupled at one end thereof to the lever portion 89*a*. With the shaft 63*a* positioned off center with respect to the secondary throttle valve 32*a*, the secondary throttle valve 32*a* will delayed in its clockwise opening motion about the shaft 63*a* since the valve 32*a* is subjected to a moment tending to turn the valve 32*a* counterclockwise about the off-center shaft 63*a* when the valve 32*a* starts opening, under a vacuum developed downstream of the valve 32*a* and acting on a wider portion thereof which is leftward of the shaft 63*a*. Conversely, the secondary throttle valve 32*a* can be closed rapidly due to the moment tending to turn the valve 32*a* counterclockwise under a vacuum acting on the wider valve portion. Slow opening movement of the secondary throttle valve 32*a* prevents sluggish engine operation under transient conditions which is caused as by less responsive or retarded fuel supply. When the secondary throttle valve 32*a* is closed quickly, the flow of an unnecessary air-fuel mixture is rapidly blocked so that the engine can be put back into an idling mode of operation speedily and stably, fuel economy can be improved, and pollutants in the exhaust gas can be reduced.

Figure 7:
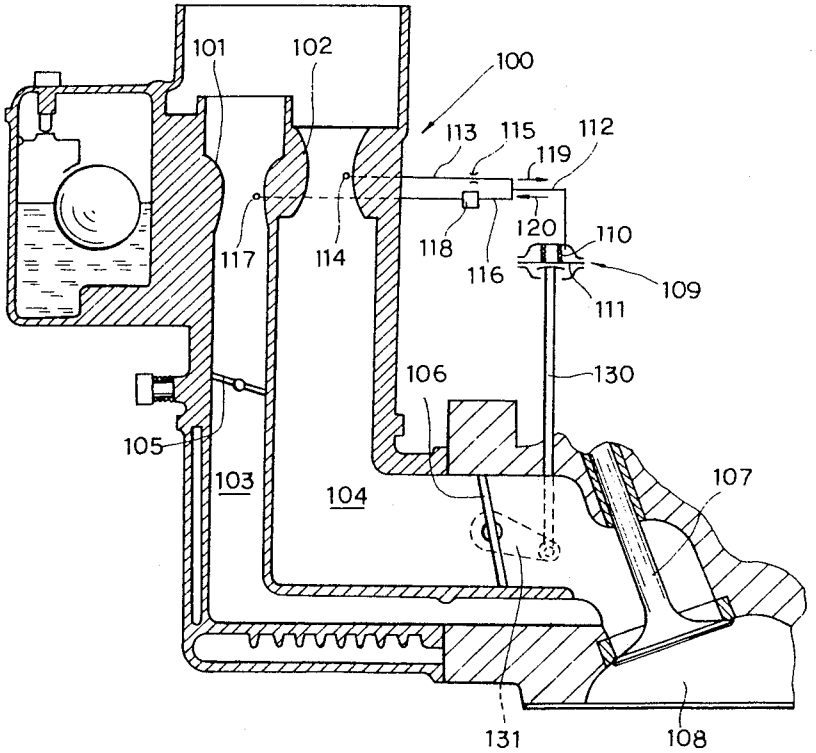
FIG. 7 is a vertical cross-sectional view of an intake system according to another embodiment of the present invention.

FIG. 7 illustrates an air-fuel mixture intake apparatus according to another embodiment of the present invention. The air-fuel mixture intake apparatus comprises a duplex or two-barrel carburetor 100 having a primary venturi 101 operable under all load conditions and a secondary venturi 102 which can be put into operation under medium and high loads, a primary intake passage 103 communicating with the primary venturi 101, a secondary intake passage 104 communicating with the secondary venturi 102, a primary throttle valve 105 disposed in the primary intake passage 103, and a secondary throttle valve 106 disposed in the secondary intake passage 104. The secondary intake passage 104 opens through an intake valve 107 into a combustion chamber 108, the primary intake passage 103 opening into the secondary intake passage 104 adjacent to the intake valve 107.

The secondary throttle valve 106 is operably by a vacuum-operated actuator 109 comprising a vacuum chamber 110 defined partly by a spring-loaded diaphragm 111 and communicating with a common vacuum signal passageway 112, which is connected via a secondary vacuum signal passageway 113 having an orifice or restrictor 115 to a secondary vacuum pickup port or probe 114 located at the secondary venturi 102 and which is also connected via a primary vacuum signal passageway 116 to a primary vacuum pickup port or probe 117 located at the primary venturi 101. The primary vacuum signal passageway 116 includes a known delay valve 118 such as a vacuum transmitting valve which serves to allow air to flow unobstructedly through the passageway 116 in the direction of the arrow 119, but to delay an air flow in the direction of the arrow 120. A link rod 130 is connected at one end to the diaphragm 111 of the vacuum-operated actuator 109 and at the other end to a throttle lever 131 fixed to the secondary throttle valve 106. The spring-loaded diaphragm 111 is normally biased in a direction to enlarge the vacuum chamber 111, or to cause the secondary throttle valve 106 to close off the secondary intake passage 104.

In operation, when the primary throttle valve 105 is substantially fully opened as the engine load increases, a greater vacuum is developed in the primary venturi 101, and transmitted from the primary vacuum pickup port 117 through the primary vacuum signal passageway 116 and the common vacuum signal passageway 112 into the vacuum chamber 110, whereupon the diaphragm 111 is caused to be displaced against the spring force, moving the link rod 130 to open the secondary throttle valve 106. With the secondary throttle valve 106 thus open, the secondary venturi 102 develops a greater vacuum therein which is introduced from the secondary vacuum pickup port 114 through the secondary vacuum signal passageway 113 and the common vacuum signal passageway 112 into the vacuum chamber 110. The vacuums picked up from the primary and secondary venturis 101, 102 are combined in the vacuum chamber 110 forcing the diaphragm 111 to be displaced further in the direction to open the secondary throttle valve 106. Since the air flow in the direction of the arrow 120 through the primary vacuum signal passageway 116 is restricted by the delay valve 118, the secondary throttle valve 106 is delayed or slowed down in its opening motion, compensating for retarded fuel supply in transient operating conditions to thereby achieve smooth engine operation.

When the primary throttle valve 105 is closed during deceleration, the primary venturi 101 is kept substantially at the atmospheric pressure which is introduced immediately through the passageways 116, 112 without delay into the vacuum chamber 110, whereupon the diaphragm 111 is returned under the force of the spring to cause the link rod 130 to close the secondary throttle valve 106. As the delay valve 118 permits air to flow unobstructedly in the direction of the arrow 119, the diaphragm 111 responds quickly and the secondary throttle valve 106 is closed quickly, so that the secondary throttle valve 106 is prevented from bouncing which would otherwise occur due to an increased vacuum in the combustion chamber 108. Accordingly, the engine can be put back rapidly into an idling mode of operation.

Figure 8:
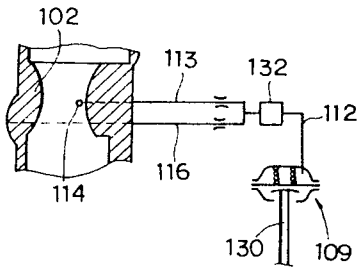
FIG. 8 is a diagrammatic view illustrative of a modification of a vacuum passage.

As an alternative, a delay valve 132 may be disposed in the common vacuum signal passageway 112 in which vacuums from the primary and secondary venturis are combined, as shown in FIG. 8.

Figure 9:
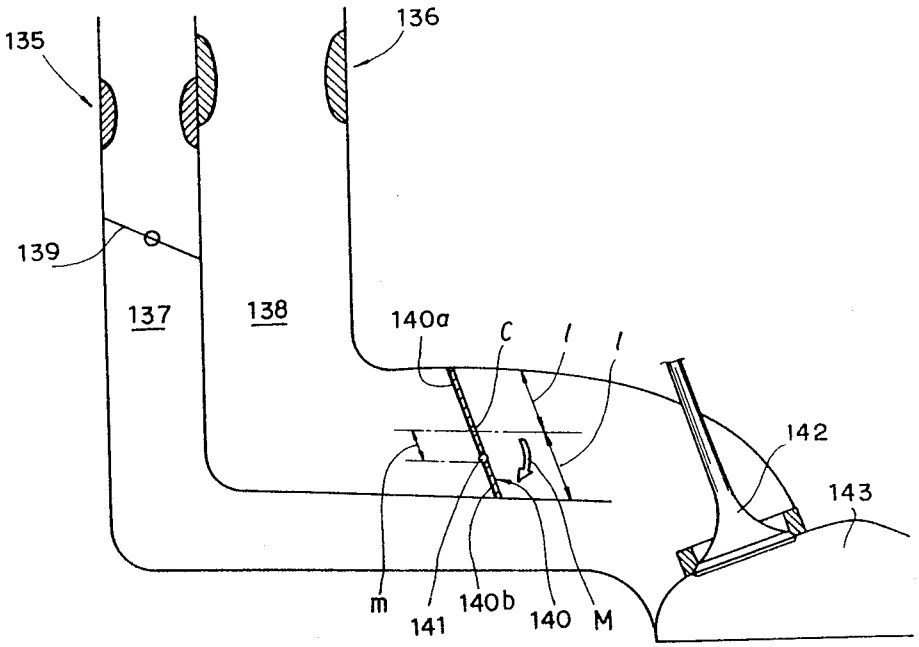
FIG. 9 is a schematic view of an intake system according to still another embodiment of the present invention.

According to still another embodiment shown in FIG. 9, primary and secondary venturis 135, 136 are connected respectively to primary and secondary intake passages 137, 138 having therein primary and secondary throttle valves 139, 140, respectively, and opening through an intake valve 142 into a combustion chamber 143. The secondary throttle valve 140 is supported on a shaft 141 for angular movement thereabout which is displaced downstream off the geometric center c of the throttle valve 140 by the distance m. The secondary throttle valve 140 has a wider portion 140*a* disposed upstream of the shaft 141 and a smaller portion 140*b* disposed downstream of the shaft 141. The wider portion 140*a* has a vertical extent $l+m$ from an upper edge thereof to the shaft 141, and the smaller portion 140*b* has a vertical extent $l-m$ from a lower edge thereof to the shaft 141, where l is the distance between the geometric center c and the upper or lower edge of the throttle valve 140.

When the secondary throttle valve 140 is actuated by a vacuum-operated actuator or a linkage mechanism operatively coupled to the primary throttle valve 139, the wider portion 140*a* is subjected to a larger force under a vacuum developed downstream of the secondary throttle valve 140 than the force acting on the smaller portion 140*b*, so that the secondary throttle valve 140 undergoes a moment M tending to turn itself clockwise about the shaft 141. Therefore, the secondary throttle valve 140 is delayed or slowed down in its opening motion to thereby prevent sluggish engine operation due to retarded fuel supply under transient operating conditions.

The secondary throttle valve 140 can be closed quickly and reliably under the moment M imposed to cut off an undesired flow of air-fuel mixture through the secondary intake passage 138 immediately when an air-fuel mixture is to be introduced only through the primary intake passage 13 into the combustion chamber 143 while the engine is under light loads.

With the air-fuel mixture intake apparatus shown in FIGS. 7 through 9, slow movement of the secondary throttle valve as it opens can compensate for retarded fuel supply under transient operating conditions, thereby preventing sluggish engine operation. The engine can be put back smoothly and stably into an idling mode of operation since the secondary throttle valve is quickly closable to block an unnecessary flow of air-fuel mixture therethrough, with the results that fuel economy can be improved and harmful pollutants in the exhaust gas discharged from the engine can be reduced. Rapid and reliable reclosure of the secondary throttle valve assures an increased degree of sealing therearound, rendering it unnecessary to take into account a leakage of air-fuel mixture through the secondary intake passage. The engine rpm can thus be held at a constant minimum during idling, an additional contribution to improved fuel economy and exhaust gas purification.

Although certain preferred embodiments have been shown and described in detail, it should be understood that many changes and modifications may be made therein without departing from the scope of the appended claims.

What is claimed is:

1. An air-fuel mixture intake apparatus for an internal combustion engine having a combustion chamber and an intake valve therefor, said apparatus comprising:

a primary intake passage having a primary venturi and a primary intake passage for providing communication between said primary venturi and the combustion chamber to supply an air-fuel mixture into the combustion chamber under all loads;

a secondary intake passage having a secondary venturi and a secondary intake passage for providing communication between said secondary venturi and the combustion chamber to supply an air-fuel mixture into the combustion chamber under medium and high loads;

a primary throttle valve disposed in said primary intake passage;

a secondary throttle valve disposed in said secondary intake passage;

a vacuum-operated actuator for said secondary throttle valve having primary and secondary vacuum pickup probes respectively in said primary and secondary venturis, a vacuum chamber, a diaphragm partly defining said vacuum chamber, a link rod operatively coupled to said secondary throttle valve, primary and secondary vacuum signal passageways respectively connected to said primary and secondary vacuum pickup probes, and a common vacuum signal passageway communicating between said vacuum chamber and said primary and secondary vacuum signal passageways, said diaphragm being displaceable to cause said link rod to open said secondary throttle valve when a predetermined vacuum developed in said primary venturi and subsequently in said secondary venturi is introduced into said vacuum chamber through said primary and secondary vacuum signal passageways and said common vacuum signal passageway; and means for slowing down said secondary throttle valve in its opening motion, said means comprising a delay valve disposed in said primary vacuum signal passageway for delaying an air flow therethrough toward said primary vacuum pickup probe.

2. An air-fuel mixture intake apparatus for an internal combustion engine having a combustion chamber and an intake valve therefor, said apparatus comprising:

a primary intake passage having a primary venturi and a primary intake passage for providing communication between said primary venturi and the combustion chamber to supply an air-fuel mixture into the combustion chamber under all loads;

a secondary intake passage having a secondary venturi and a secondary intake passage for providing communication between said secondary venturi and the combustion chamber to supply an air-fuel mixture into the combustion chamber under medium and high loads;

a primary throttle valve disposed in said primary intake passage;

a secondary throttle valve disposed in said secondary intake passage;

a vacuum-operated actuator means for said secondary throttle having a vacuum chamber, a diaphragm partly defining said vacuum chamber, a link rod operatively coupled between said diaphragm and said secondary throttle valve, primary and secondary vacuum pickup probes respectively communicating with said primary and secondary venturis, and vacuum signal passageway means communicating between said vacuum chamber and said primary and secondary vacuum pickup probes, said vacuum signal passageway means including primary and secondary vacuum signal passageways communicating respectively with said primary and secondary vacuum pickup probes and a comnon vacuum signal passageway communicating between said vacuum chamber and said primary and secondary vacuum signal passageways, said diaphragm being displaceable to cause said link rod to open said secondary throttle valve when a predetermined vacuum developed in said primary venturi and subsequently in said secondary venturi is introduced into said vacuum chamber through said vacuum signal passageway means; and means for slowing down said secondary throttle valve in its opening motion, said means comprising delay valve means disposed in said primary vacuum signal passageway for permitting unrestricted air flow through said passageway means in a direction toward said vacuum chamber while delaying air flow through said primary vacuum signal passageway in the opposite direction.

3. An air-fuel mixture intake apparatus for an internal combustion engine having a combustion chamber and an intake valve therefor, said apparatus comprising:

a primary intake system having a fixed venturi for supplying an air-fuel mixture into the combustion chamber under all loads, said primary intake system including a primary intake passage for providing communication between said fixed venturi and the combustion chamber;

a secondary intake system having a variable venturi for supplying an air-fuel mixture into the combustion chamber under medium and high loads, said secondary intake system including a secondary intake passage for providing communication between said variable venturi and the combustion chamber, said primary intake passage opening at one end into said secondary intake passage so as to be adjacent to the intake valve, said variable venturi being variable in cross section dependent on the vacuum developed therein;

said primary and secondary intake passages including therein primary and secondary throttle valves, respectively;

a vacuum-operated actuator having vacuum pickup probes respectively in said fixed and variable venturis for actuating said secondary throttle valve when there is developed a predetermined vacuum in said fixed venturi and subsequently in said variable venturi upon opening of said primary throttle valve;

said vacuum-operated actuator comprising a vacuum chamber, a diaphragm by which said vacuum chamber is partly defined, a rod connected to said diaphragm and said secondary throttle valve, a primary vacuum signal passageway having a primary vacuum pickup probe disposed in said primary venturi, a secondary vacuum signal passageway having a secondary vacuum pickup probe disposed in said secondary venture, a common vacuum signal passageway connected between said primary and secondary vacuum signal passageways and said vacuum chamber, and a delay valve disposed in said primary vacuum signal passageway for delaying an air flow through said primary vacuum signal passageway toward said primary vacuum pickup proble; and a linkage mechanism operatively connected between said primary and secondary throttle valves for allowing said secondary throttle valve to open after said primary throttle valve has opened to a predetermined degree and for limiting the maximum opening of said secondary throttle valve dependent on the opening of said primary throttle valve after the latter has opened beyond said predetermined degree.

4. An air-fuel mixture intake apparatus according to claim 3, said variable venturi comprising a second vacuum chamber, a second diaphragm by which said second vacuum chamber is partly defined, a piston valve connected to said second diaphragm and spring-biased in a direction to move into a venturi tube communicating with said secondary intake passage, and passage means communicating between said venturi tube and said second vacuum chamber, said piston valve being movable in a direction out of said venturi tube in response to a vacuum developed in said venturi tube.

5. An air-fuel mixture intake apparatus according to claim 3, said linkage mechanism comprising a first lever rotatably mounted on a shaft to which said primary throttle valve is fixed, a second lever rotatably mounted on a shaft to which said secondary throttle valve is fixed, and a rod interconnecting said first and second levers, said second lever having means for limiting opening of said secondary throttle valve, said shaft to which said primary throttle valve is fixed having means for actuating said linkage mechanism to displace said limiting means on said second lever when said primary throttle valve opens beyond said predetermined degree.

6. An air-fuel mixture intake apparatus according to claim 3, said secondary throttle valve being supported on a shaft for rotation thereabout, said shaft being displaced from the geometric center of said secondary throttle valve in a downstream direction with respect to the direction of flow of an air-fuel mixture through said secondary intake passage.

* * * * *